US007390216B1

(12) United States Patent
Lee

(10) Patent No.: US 7,390,216 B1
(45) Date of Patent: Jun. 24, 2008

(54) LATCH-TYPE STACKABLE CONNECTOR

(75) Inventor: Ipson Lee, Taoyuan (TW)

(73) Assignee: Super Link Electrronics Co., Ltd., Taoyuan Hsien (TW)

( * ) Notice: Subject to any disclaimer, the term of this patent is extended or adjusted under 35 U.S.C. 154(b) by 0 days.

(21) Appl. No.: 11/802,597

(22) Filed: May 24, 2007

(51) Int. Cl.
*H01R 13/635* (2006.01)

(52) U.S. Cl. ..... 439/541.5; 439/570

(58) Field of Classification Search ..... 439/64, 439/541.5, 570
See application file for complete search history.

(56) References Cited

U.S. PATENT DOCUMENTS 5,591,047 A * 1/1997 Yamada et al. ..... 439/541.5
5,788,347 A * 8/1998 Rabinovitz ..... 312/111
7,318,746 B2 * 1/2008 Ezaki ..... 439/541.5

* cited by examiner

*Primary Examiner*—James Harvey
(74) *Attorney, Agent, or Firm*—Rosenberg, Klein & Lee

(57) ABSTRACT

A latch-type stackable connector includes a base seat having an insulating seat. Multiple terminals are side by side inlaid in the insulating seat. Multiple fixing latch pieces are respectively inserted in two sides of the insulating seat. Each fixing latch piece having a first end extending to a bottom of the insulating seat to be soldered on a circuit board. A connector having an insulating bed. Multiple terminals are side by side inlaid in the insulating bed. Latching pieces are respectively inserted in two sides of the insulating bed. Each latching piece has a first end protruding from a bottom of the insulating bed to be latched with a second end of the fixing latch piece. A second end of the latching piece is correspondingly tightly latchable with the first end of the latching piece of another connector.

9 Claims, 5 Drawing Sheets

LATCH-TYPE STACKABLE CONNECTOR

BACKGROUND OF THE INVENTION

1. Field of the Invention

The present invention is related to a latch-type stackable connector, and more particularly to a stackable connector in which two fixing latch pieces are respectively mounted on two sides of the base seat. In addition, two latching pieces are respectively inserted in two sides of the connector. When the connectors are stacked on the base seat, the latching pieces are latched with the fixing latch pieces of the base seat or latched with each other to firmly fix the connectors and stack the connectors on the base seat.

2. Description of the Prior Art

In general, packaged body such as nand flash is mounted on the circuit board of a computer or other electronic digital product to speed the processing. Conventionally, the packaged bodies are one by one soldered on the circuit board. Accordingly, each packaged body will occupy a certain space of the circuit board. In the case that numerous packaged bodies are to be mounted, the surface of the circuit board must be increased. Under such circumstance, it is impossible to minimize the volume of the product. Furthermore, in the case that a user needs to expand and add some packaged bodies on the circuit board, there will be no reserved space for the additional packaged bodies. As a result, it is necessary for the user to remove the original packaged body and replace the original packaged body with a new one with larger capacity or higher rank. Such replacement can be hardly done by a common user.

SUMMARY OF THE INVENTION

It is therefore a primary object of the present invention to provide a latch-type stackable connector including: a base seat having an insulating seat, multiple terminal cavities being side by side formed on the insulating seat, multiple terminals being respectively inlaid in the terminal cavities, two connecting dents being respectively formed on two sides of the insulating seat, a fixing latch piece being inserted in each fixing dent, the fixing latch piece having a first end extending to a bottom of the insulating seat to be soldered on a fixing contact of a circuit board; and a connector having an insulating bed, multiple terminal cavities being side by side formed on the insulating bed, multiple terminals being respectively inlaid in the terminal cavities, two latching dents being respectively formed on two sides of the insulating bed, a latching piece being inserted in each latching dent, the latching piece having a first end protruding from a bottom of the insulating bed to be latched with a second end of the fixing latch piece, a second end of the latching piece being correspondingly tightly latchable with the first end of the latching piece of another connector. Accordingly, multiple connectors can be firmly latched with each other and stacked on the base seat.

The present invention can be best understood through the following description and accompanying drawings wherein:

DETAILED DESCRIPTION OF THE PREFERRED EMBODIMENTS

Figure 1:
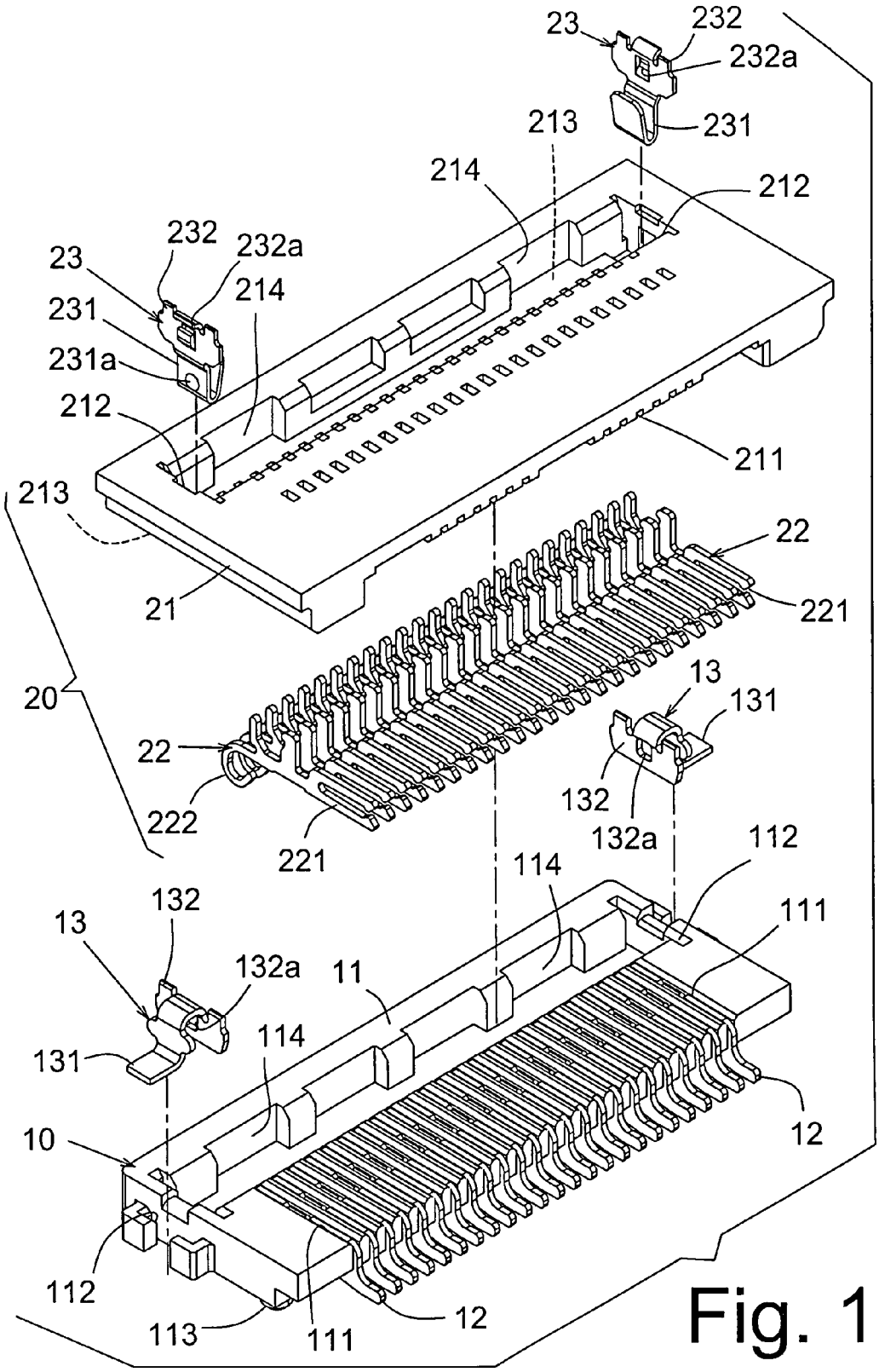
FIG. 1 is a perspective exploded view of the present invention.

Please refer to FIGS. 1 to 8. The latch-type stackable connector of the present invention includes a base seat 10 having an insulating seat 11. Multiple terminal cavities 111 are side by side formed on the insulating seat 11. Multiple terminals 12 are respectively inlaid in the terminal cavities 111. Two connecting dents 112 are respectively formed on two sides of the insulating seat 11. A fixing latch piece 13 is inserted in each fixing dent 112. The fixing latch piece 13 has a first end 131 extending to a bottom of the insulating seat 11 to be soldered on the fixing contact of a circuit board 30. The present invention further includes a connector 20 having an insulating bed 21. Multiple terminal cavities 211 are side by side formed on the insulating bed 21. Multiple terminals 22 are respectively inlaid in the terminal cavities 211. Two latching dents 212 are respectively formed on two sides of the insulating bed 21. A latching piece 23 is inserted in each latching dent 212. The latching piece 23 has a first end 231 protruding from a bottom of the insulating bed 21 to be latched with a second end 132 of the fixing latch piece 13. A second end 232 of the latching piece 23 can be correspondingly tightly latched with the first end 231 of the latching piece 23 of another connector 20. Accordingly, multiple connectors 20 can be firmly latched with each other and stacked on the base seat 10.

Figure 2:
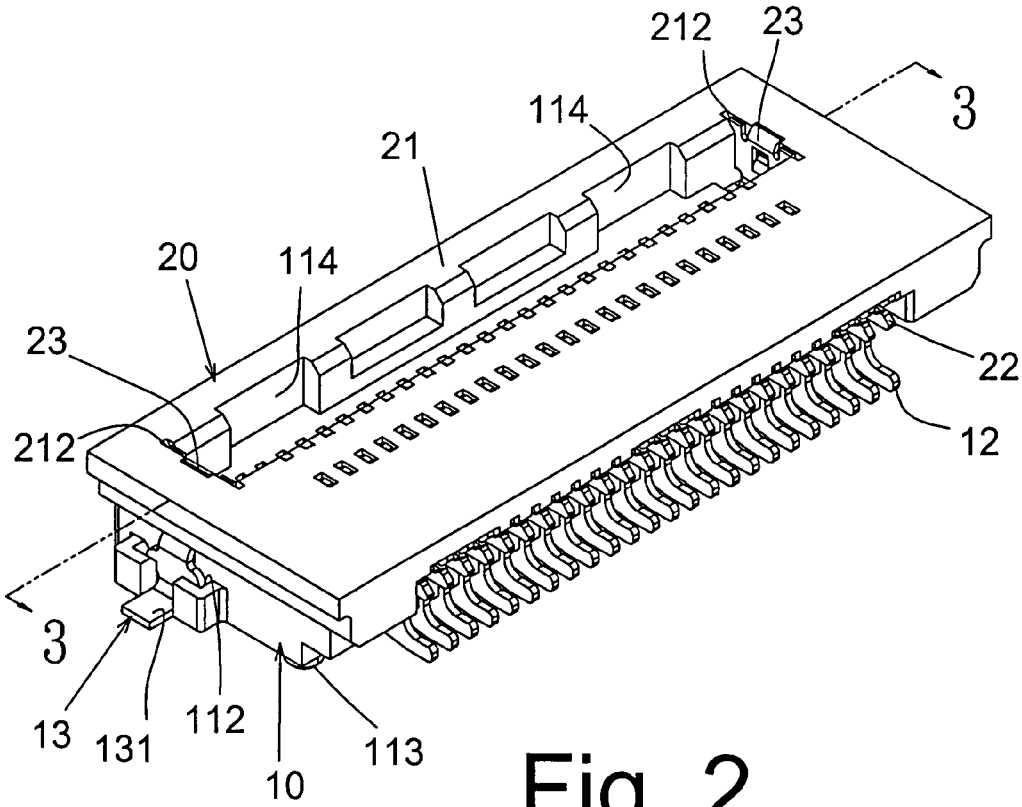
FIG. 2 is a perspective assembled view of the present invention.
Figure 3:
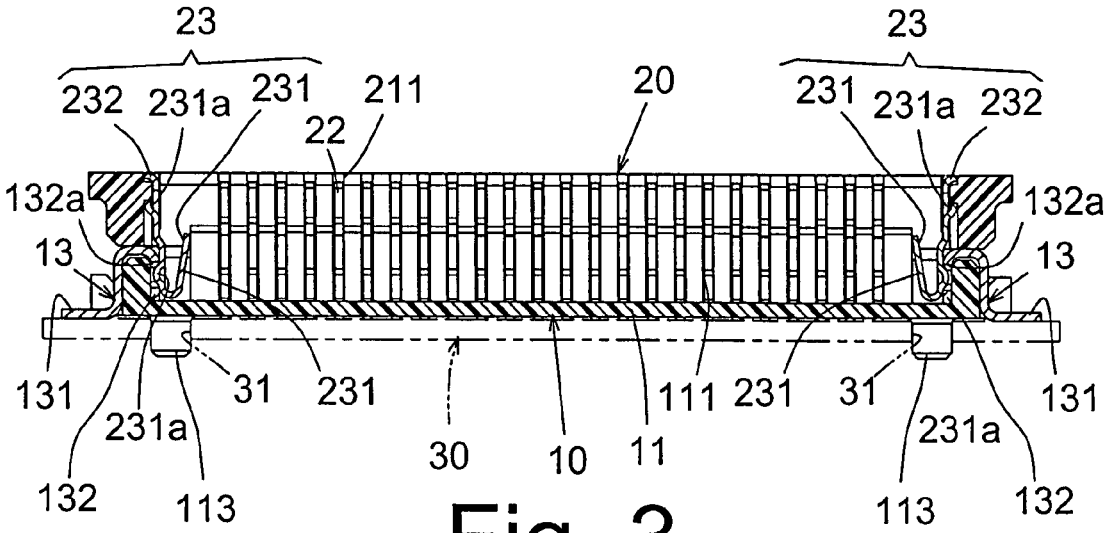
FIG. 3 is a sectional view taken along line 3-3 of FIG. 2.
Figure 4:
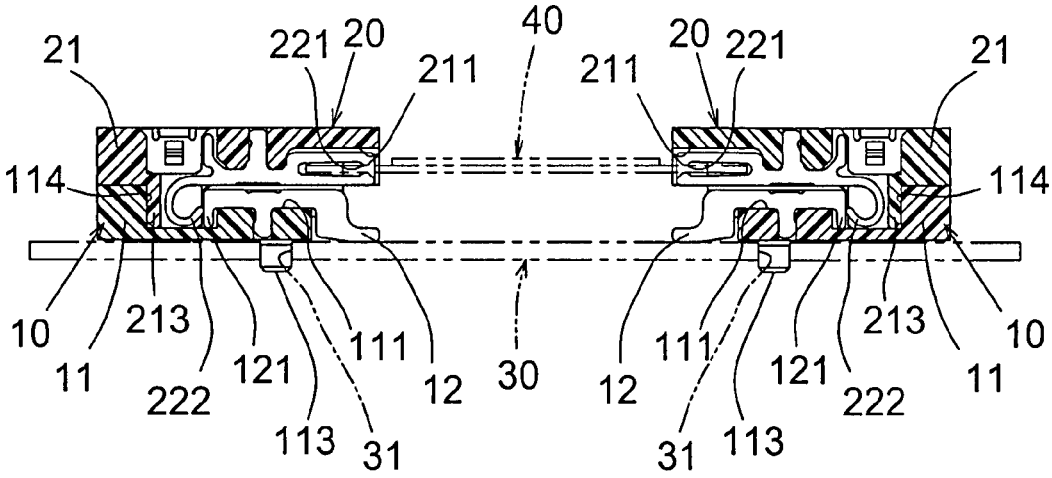
FIG. 4 is a sectional view of the present invention, showing that a packaged body is clipped between the connectors.
Figure 5:
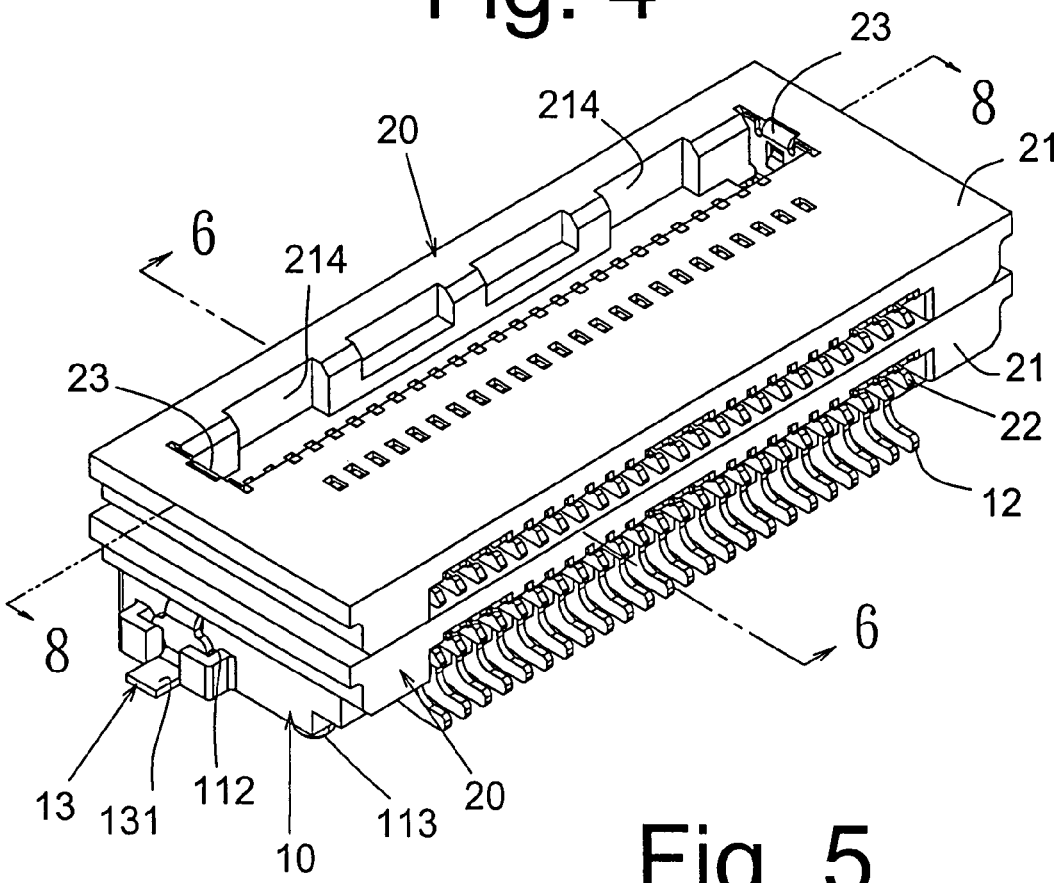
FIG. 5 is a perspective view showing that two connectors are stacked on the base seat.
Figure 6:
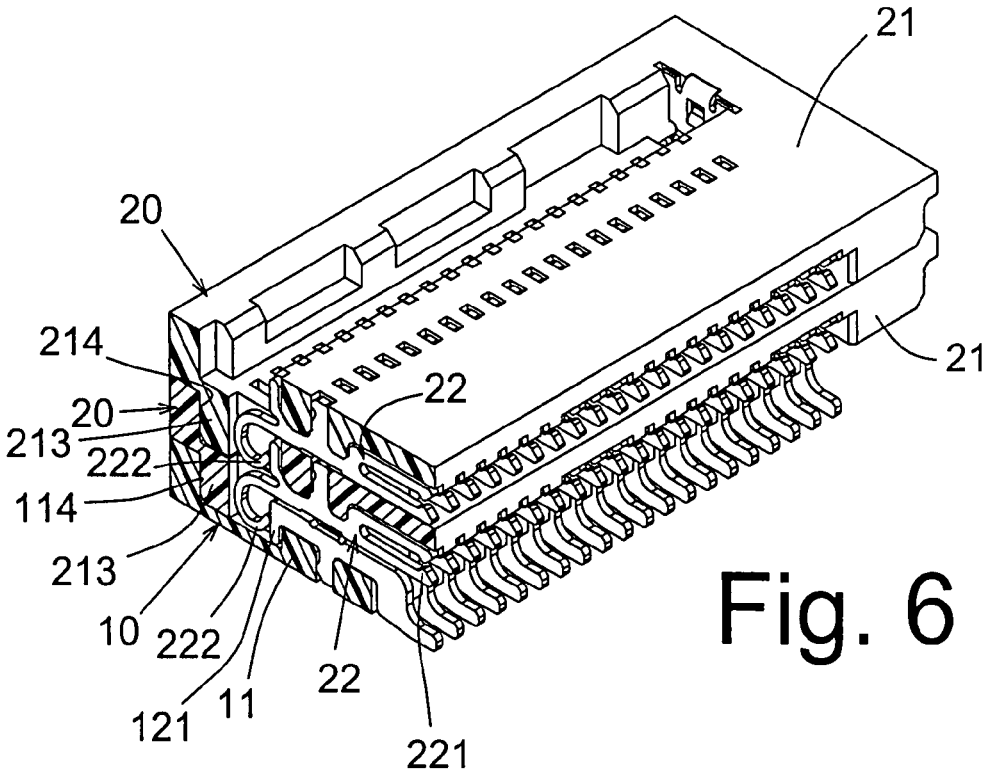
FIG. 6 is a perspective sectional view taken along line 6-6 of FIG. 5.

Referring to FIG. 3, in the latch-type stackable connector of the present invention, locating bosses 113 protrude from the bottom of the insulating seat 11 of the base seat 10. The locating bosses 113 are inserted in the corresponding latch holes 31 of the circuit board 30. Referring to FIGS. 1, 2 and 4, a face of the insulating seat 11, on which the connectors 20 are stacked, is formed with multiple guide mortises 114. The insulating bed 21 of the connector 20 is formed with corresponding tenons 213. The tenons 213 are accurately guided and slid into the guide mortises 114, whereby the connectors 20 can be stacked on the base seat 10.

Referring to FIGS. 1 and 3, the second end 132 of the fixing latch piece 13 of the base seat 10 is bent and U-shaped. The second end 132 is formed with a locating hole 132*a*. The first end 231 of the latching piece 23 of the connector 20 is formed with a locating protuberance 231*a* which can be correspondingly resiliently latched in the locating hole 132*a*.

Referring to FIG. 4, the terminal 12 of the base seat 10 has a contact end 121 for correspondingly contacting with a second end 222 of the terminal 22 of the connector 20.

Referring to FIGS. 1 to 8, a first end face of the insulating bed 21 of the connector 20 is formed with tenons 213, while a second end face of the insulating bed 21 is formed with locating mortises 214. Accordingly, the tenons 213 of the first end face of the insulating bed 21 of another connector 20 can be inserted in the locating mortises 214 of the second end face of the insulating bed 21 so as to accurately locate and stack the connectors 20.

Figure 7:
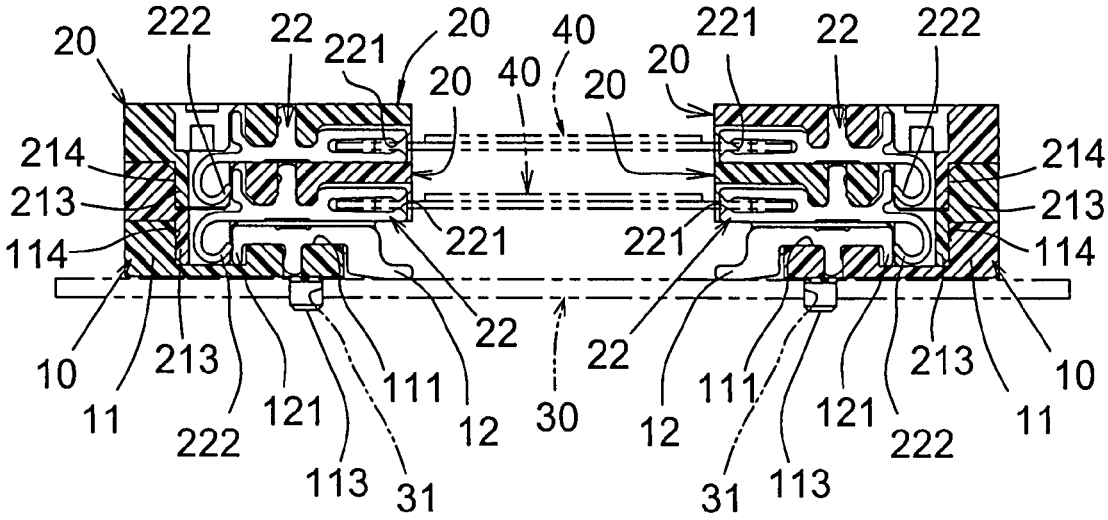
FIG. 7 is a sectional view of the present invention, showing that multiple packaged bodies are clipped between multiple connectors stacked on the base seat.
Figure 8:
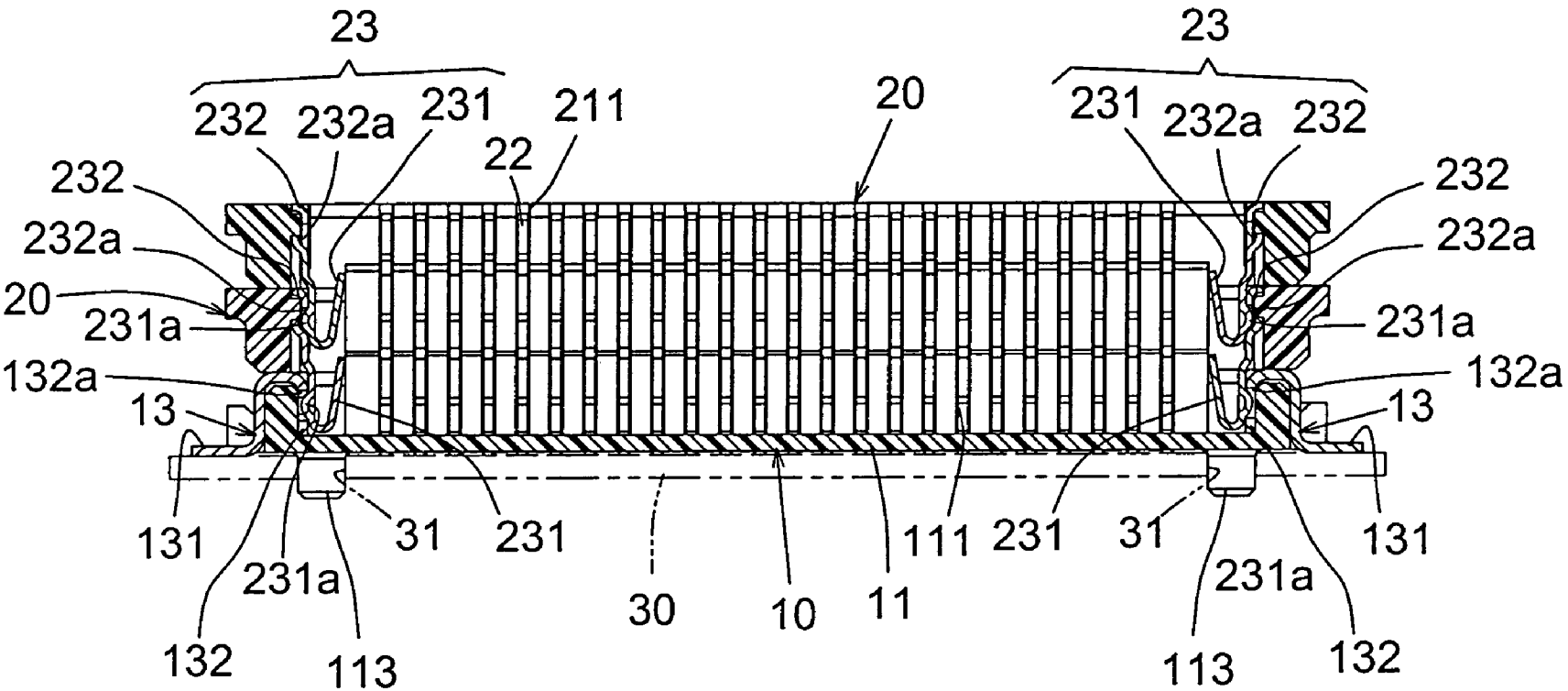
FIG. 8 is a sectional view taken along line 8-8 of FIG. 5.

Referring to FIGS. 1, 4 and 7, a first end 221 of the terminal 22 inlaid in the terminal cavity 211 of the connector 20 is formed with a clipping split for clipping a packaged body 40 such as a nand flash. The first end 221 is electrically connected with the corresponding contacts of the packaged body 40. A second end 222 of the terminal 22 is bent into a resilient arm for resiliently contacting with the contact end 121 of the terminal 12 of the base seat 10 or resiliently contacting with the second end 222 of the terminal 22 of another connector 20.

Referring to FIGS. 1, 3, 6 and 8, a first end 231 of the latching piece 23 inserted in the latching dent 212 of the insulating bed 21 is bent and U-shaped. The first end 231 is also formed with a locating protuberance 231*a*. A second end 232 of the latching piece 23 is formed with a locating hole 232*a*. The locating protuberance 231*a* of the first end 231 of the latching piece 23 of another connector 20 can be correspondingly latched in the locating hole 232*a* to firmly latch and stack the connectors 20.

Referring to FIGS. 5 to 8, in practice, two base seats 10 can be oppositely mounted on a circuit board 30. Then, two connectors 20 oppositely clipping two sides of a packaged body 40 are latched on the base seats 10. When it is necessary to add another packaged body 40, two additional connectors 20 clipping the other packaged body 40 are respectively overlaid on and latched with the original connectors 20 previously latched on the base seats 10. Accordingly, the connectors 20 can be unlimitedly stacked on the base seats 10 to parallelly connect multiple packaged bodies 40.

According to the above arrangement, the latch-type stackable connector present invention has the following advantages:

1. Two fixing latch pieces 13 are respectively inserted in two sides of the base seat 10. Two latching pieces 23 are respectively inserted in two sides of the connector 20. When the connectors 20 are stacked on the base seat 10, the fixing latch pieces 13 are latched with the latching pieces 23 to firmly fix the connectors 20 and stack the connectors 20 on the base seat 10.

2. When multiple connectors 20 are stacked, two adjacent connectors 20 can be latched with each other by means of the latching pieces 23 on the two sides. Accordingly, the connectors 20 can be firmly stacked together.

3. The base seat 10 is formed with guide mortises 114, whereby the corresponding tenons 213 of the connector 20 can be slid into the guide mortises 114 so as to quickly accurately latch the connector 20 with the base seat 10 and stack the connectors 20 thereon.

4. The first end face of the insulating bed 21 of the connector 20 is formed with tenons 213, while a second end face of the insulating bed 21 is formed with locating mortises 214. Accordingly, the tenons 213 of the first end face of the insulating bed 21 of another connector 20 can be inserted in the locating mortises 214 of the second end face of the insulating bed 21 so as to quickly accurately latch and stack multiple connectors 20.

The above embodiments are only used to illustrate the present invention, not intended to limit the scope thereof. Many modifications of the above embodiments can be made without departing from the spirit of the present invention.

What is claimed is:

1. A latch-type stackable connector comprising:

(a) a base seat having an insulating seat, multiple terminal cavities being side by side formed on the insulating seat, multiple terminals being respectively inlaid in the terminal cavities, two connecting dents being respectively formed on two sides of the insulating seat, a connecting latch piece being inserted in each fixing dent, the fixing latch piece having a first end extending to a bottom of the insulating seat to be soldered on a fixing contact of a circuit board; and (b) a connector having an insulating bed, multiple terminal cavities being side by side formed on the insulating bed, multiple terminals being respectively inlaid in the terminal cavities, two latching dents being respectively formed on two sides of the insulating bed, a latching piece being inserted in each latching dent, the latching piece having a first end protruding from a bottom of the insulating bed to be latched with a second end of the fixing latch piece, a second end of the latching piece being correspondingly tightly latchable with the first end of the latching piece of another connector.

2. The latch-type stackable connector as claimed in claim 1, wherein several locating bosses protrude from the bottom of the insulating seat of the base seat, whereby the locating bosses are inserted in corresponding latch holes of the circuit board.

3. The latch-type stackable connector as claimed in claim 1, wherein a face of the insulating seat of the base seat, on which the connectors are stacked, is formed with multiple guide mortises, the insulating bed of the connector being formed with corresponding tenons, whereby the tenons can be guided and slid into the guide mortises.

4. The latch-type stackable connector as claimed in claim 1, wherein the second end of the fixing latch piece of the base seat is bent and U-shaped, the second end being formed with a locating hole, the first end of the latching piece of the connector being formed with a locating protuberance which can be correspondingly resiliently latched in the locating hole.

5. The latch-type stackable connector as claimed in claim 1, wherein the terminal of the base seat has a contact end for correspondingly contacting with a second end of the terminal of the connector.

6. The latch-type stackable connector as claimed in claim 1, wherein a first end face of the insulating bed of the connector is formed with tenons, while a second end face of the insulating bed is formed with locating mortises, whereby the tenons of the first end face of the insulating bed of another connector can be inserted in the locating mortises of the second end face of the insulating bed.

7. The latch-type stackable connector as claimed in claim 1, wherein a first end of the terminal inlaid in the terminal cavity of the connector is formed with a clipping split, while the second end of the terminal of the connector is bent into a resilient arm.

8. The latch-type stackable connector as claimed in claim 1, wherein a first end of the latching piece inserted in the latching dent of the insulating bed is bent and U-shaped, the first end being also formed with a locating protuberance, a second end of the latching piece being formed with a locating hole, whereby the locating protuberance of the first end of the latching piece of another connector can be correspondingly latched in the locating hole.

9. A latch-type stackable connector comprising:

two base seat each having an insulating seat, multiple terminal cavities being side by side formed on the insulating seat, multiple terminals being respectively inlaid in the terminal cavities, two connecting dents being respectively formed on two sides of the insulating seat, a fixing latch piece being inserted in each fixing dent, the connecting latch piece having a first end extending to a bottom of the insulating seat to be soldered on a fixing contact of a circuit board; and an even number of connectors each having an insulating bed, multiple terminal cavities being side by side formed on the insulating bed, multiple terminals being respectively inlaid in the terminal cavities, whereby a packaged body can be clipped between the terminals of each two opposite connectors, two latching dents being respectively formed on two sides of the insulating bed, a latching piece being inserted in each latching dent, the latching piece having a first end protruding from a bottom of the insulating bed to be latched with a second end of the fixing latch piece, a second end of the latching piece being correspondingly tightly latchable with the first end of the latching piece of another connector, whereby the connectors can be latched with each other and stacked on the base seats.

* * * * *